US010518855B2

(12) United States Patent
Pulley et al.

(10) Patent No.: US 10,518,855 B2
(45) Date of Patent: Dec. 31, 2019

(54) MARINE VESSEL HULL HAVING PROFILED PROPULSOR POD MOUNTING SURFACE

(71) Applicant: Caterpillar Inc., Peoria, IL (US)

(72) Inventors: Benjamin Pulley, Oak Creek, WI (US); Endicott M. Fay, Bainbridge Island, WA (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/896,559

(22) Filed: Feb. 14, 2018

(65) Prior Publication Data

US 2019/0248459 A1 Aug. 15, 2019

(51) Int. Cl.

| | |
|---|---|
| ***B63H 5/08*** | (2006.01) |
| ***B63B 1/32*** | (2006.01) |
| ***B63B 1/08*** | (2006.01) |
| ***B63H 5/16*** | (2006.01) |

(52) U.S. Cl.

CPC ..... *B63H 5/08* (2013.01); *B63B 1/08* (2013.01); *B63B 1/32* (2013.01); *B63H 5/16* (2013.01)

(58) Field of Classification Search

CPC .... B63H 5/08; B63H 5/16; B63B 1/32; B63B 1/08

USPC ..... 114/56.1, 57, 59

See application file for complete search history.

(56) References Cited

U.S. PATENT DOCUMENTS

| | | | | |
|---|---|---|---|---|
| 5,711,239 | A | 1/1998 | Ramde | |
| 6,354,236 | B1 | 3/2002 | Davidson | |
| 7,188,581 | B1 * | 3/2007 | Davis | B63B 39/061 114/285 |
| 7,294,031 | B1 * | 11/2007 | Davis | B63H 5/125 440/112 |
| 7,666,040 | B2 | 2/2010 | Arvidsson | |
| 8,011,983 | B1 * | 9/2011 | Davis | B63H 5/125 440/112 |
| 8,028,636 | B2 | 10/2011 | Takashima et al. | |
| 8,740,660 | B2 * | 6/2014 | Wingate | B63B 39/06 440/53 |
| 2002/0096098 | A1 | 7/2002 | Kingsbury | |

FOREIGN PATENT DOCUMENTS

| | | | |
|---|---|---|---|
| JP | 3067267 | A1 | 9/2016 |

* cited by examiner

*Primary Examiner* — Anthony D Wiest
(74) *Attorney, Agent, or Firm* — Jonathan F. Yates

(57) ABSTRACT

A vessel hull for an inboard-powered marine vessel includes a hull body having a hull bottom that includes a contoured pod mounting surface positioned longitudinally between a central keel and a stern of the hull body. The contoured pod mounting surface has a planar mounting face, for mounting a propulsor pod, and a transition face each positioned between peripheral edges of the pod mounting surface. The transition face slopes forwardly and downwardly from the planar mounting face to the central keel and follows a contour defining a sine wave pattern.

20 Claims, 3 Drawing Sheets

MARINE VESSEL HULL HAVING PROFILED PROPULSOR POD MOUNTING SURFACE

TECHNICAL FIELD

The present disclosure relates generally to marine vessel hull design, and more particularly to a vessel hull having a profiled propulsor pod mounting surface.

BACKGROUND

Marine vessel hull technology has developed over the course of literally thousands of years. In more recent times advances in materials, design, and construction, often assisted by computer modeling, have led to a great diversity of purpose-built and high-performance designs. In parallel with technological advances in the design of vessel hulls has been development of sophisticated propulsion mechanisms, with a great many different known designs for virtually everything from propellers to steering wheels now available for different applications.

Traditionally marine vessel propulsor mechanisms employed one or more propellers driven by an internal combustion engine and supported outboard of the vessel hull, or inboard where a propeller driveshaft penetrates the vessel hull. A gearbox or transmission is typically positioned internally to the vessel hull in inboard configurations, or supported at or aft of the stern for outboards. Various combinations and variations on the basic strategies are also know. In more recent years podded designs have become popular where some of the gearing, driveshafts and the like for rotating propellers is mounted in a pod suspended below the waterline that can itself rotate relative to the vessel hull. In a typical podded propulsor configuration, each pod is associated with an engine, and provides traction for the vessel in addition to steering, with a driveline including a transmission extending between the engines and the pod. U.S. Pat. No. 7,666,040 sets forth one example of a podded azimuthing propulsor design where a propulsor pod is mounted within a so-called tunnel that runs longitudinally down a center of the hull. Among other things, tunnels provide additional surface area that can increase drag and complicate construction of the hull itself.

SUMMARY OF THE INVENTION

In one aspect, a marine vessel includes a vessel hull having a hull body with a bow, a stern, an upper hull body side, and a lower hull body side having a hull bottom. The hull bottom includes a first hull bottom side surface and a second hull bottom side surface, the first hull bottom side surface and the second hull bottom side surface adjoining one another in a V-pattern so as to form a central keel. The hull bottom further includes a contoured pod mounting surface positioned longitudinally between the central keel and the stern and having a first peripheral edge and the second peripheral edge oriented so as to diverge from one another rearwardly from the central keel. The contoured pod mounting surface further includes a planar mounting face extending forwardly from the stern, and a transition face sloping forwardly and downwardly from the planer mounting face to the central keel, such that the contoured pod mounting surface has a concave longitudinal profile. The marine vessel further includes a propulsor pod mounted upon the planar mounting face.

In another aspect, a vessel hull for an inboard-powered marine vessel includes a hull body having a bow with a forwardly positioned nose, a stern having a rearwardly positioned transom, an upper hull body side, and a lower hull body side having a hull bottom. The hull bottom includes a first hull bottom side surface and a second hull bottom side surface, the first hull bottom side surface and the second hull bottom side surface adjoining one another in a V-pattern so as to form a central keel. The hull bottom further includes a contoured pod mounting surface positioned longitudinally between the central keel and the stern and having a first peripheral edge and a second peripheral edge oriented so as to diverge from one another rearwardly from the central keel. The contoured pod mounting surface further including a planar mounting face, for mounting a propulsor pod, extending forwardly from the stern, and the transition face sloping forwardly and downwardly from the planar mounting face to the central keel, such that the contoured pod mounting surface has a concave longitudinal profile.

In still another aspect, a vessel hull for an inboard-powered marine vessel includes a hull body having a bow with a forwardly positioned nose, a stern having a rearwardly positioned transom, an upper hull body side, and a lower hull body side having a hull bottom. The hull bottom includes a first hull bottom side surface and a second hull bottom side surface, the first hull bottom side surface and the second hull bottom side surface adjoining one another in a V-pattern so as to form a central keel extending rearwardly from the bow, and a deadrise at the stern. The hull bottom further includes a contoured pod mounting surface positioned longitudinally between the central keel and the stern, and latitudinally between the first hull bottom side surface and the second hull bottom side surface. The contoured pod mounting surface has a planar mounting face, for mounting a propulsor pod, and a transition face each positioned between a first peripheral edge and a second peripheral edge. The first peripheral edge and the second peripheral edge extend from the central keel to the transom and are oriented to as to diverge from one another rearwardly from the central keel. The planar mounting face and the transition face are each positioned between the first peripheral edge and the second peripheral edge, and the transition face slopes forwardly and downwardly from the planar mounting face to the central keel.

DETAILED DESCRIPTION

Figure 1:
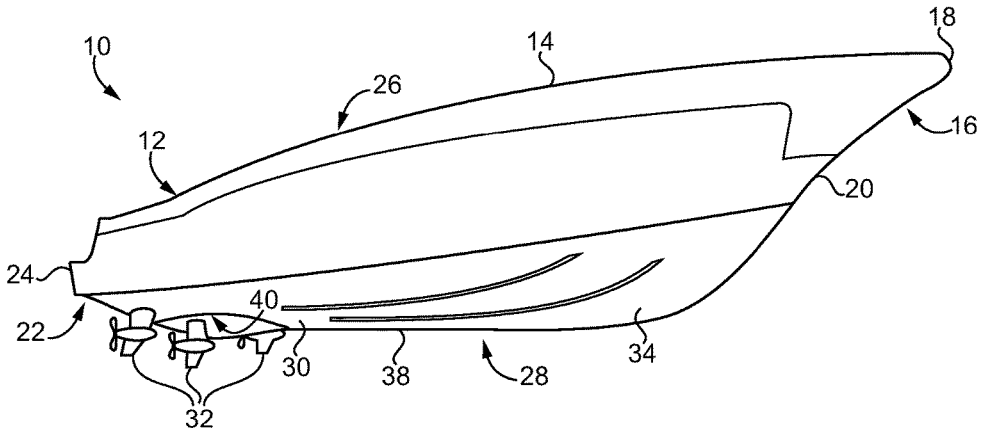
FIG. 1 is a diagrammatic view, in perspective, of a marine vessel, according to one embodiment.

Referring to FIG. 1, there is shown a marine vessel 10 according to one embodiment, and including a vessel hull 12 having a hull body 14 with a bow 16 having a forwardly positioned nose 18 that adjoins a bow stem 20, and a stern 22. Stern 22 includes a transom 24. Hull body 14 further includes an upper hull body side 26, and a lower hull body side 28 having a hull bottom 30. A plurality of propulsors 32 are shown mounted to hull bottom 30 adjacent to stern 22. In the illustrated embodiment, a total of three propulsors are shown, including a propulsor 32 on a starboard side, a propulsor 32 on a port side, and a center propulsor 32 mounted substantially along a centerline of hull body 14. Propulsors 32 can be podded propulsors, each equipped with a propeller and directional gearing. One or more internal combustion engines (not shown), and typically one internal combustion engine for each propulsor 32, may be positioned onboard marine vessel 10 and coupled to the corresponding propulsor by way of a transmission. Propulsors 32 can be propulsor pods known generally in the art as azimuthing propulsors. The center propulsor 32 might not be rotatable, whereas the starboard propulsor 32 and port propulsor 32 may be rotatable about respective vertical axes to steer marine vessel 10. In other instances, rather than three propulsors only a single propulsor might be used and mounted along the hull body centerline. Moreover, propulsors 32 might be podded electrically powered propulsors, for instance.

Figure 2:
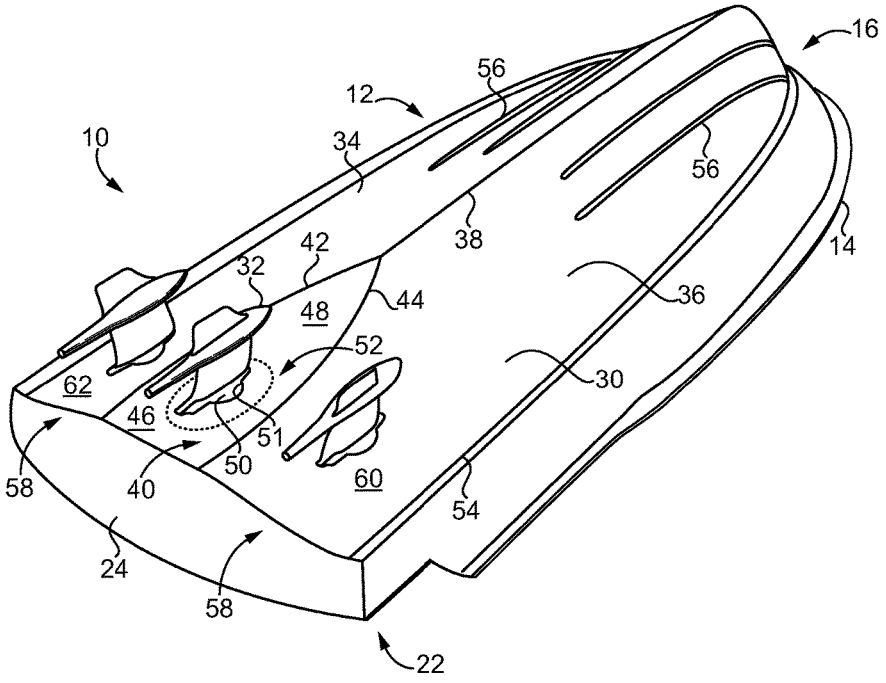
FIG. 2 is a perspective view of the marine vessel of FIG. 1, flipped over.

Referring also now to FIG. 2, hull body 14 can include a first hull bottom side surface 34 and a second hull bottom side surface 36 (hereinafter "side surface 34" and "side surface 36"). Side surface 34 and side surface 36 adjoin one another in a V-pattern so as to form a central keel 38 that extends a majority of a length of marine vessel 10 from transom 24 to nose 18, as further discussed herein. Central keel 38 extends rearwardly from bow 16, and side surface 34 and side surface 36 may further form a deadrise 58 at stern 22. FIG. 2 also illustrates a plurality of lifting strakes 56 that extend longitudinally along hull bottom 30, typically a distance that is less than half of the length of marine vessel 10, and a chine 54 extending between bow 16 and stern 22 that separates hull bottom 30 from hull body lateral sides (not numbered). In the illustrated embodiment, side surface 34 and side surface 36 may extend all the way from bow stem 20 to transom 24, although the relative angle formed by side surface 34 and side surface 36 may become shallower approaching transom 24 to ultimately form deadrise 58 on each of a port side and a starboard side. A mounting surface 60 for one of propulsors 32 to the port side of the center propulsor 32, and another mounting surface 62 for another one of propulsors 32 to the starboard side of the center propulsor 32 are also shown in FIG. 2. Each of mounting surfaces 60 and 62 may be planar such that the corresponding side surface 36 and side surface 34, respectively, transitions from a non-planar shape closer to bow 16 to a planar shape at surfaces 60 and 62 where propulsors 32 are to be mounted.

Hull bottom 30 further includes a contoured pod mounting surface 40 (hereinafter "mounting surface 40") positioned longitudinally between central keel 38 and stern 22, and latitudinally between side surface 34 and side surface 36. As used herein, the term "longitudinal" should be understood to refer to fore to aft directions generally along a centerline of hull body 14 that is parallel to central keel 38. "Latitudinal" refers to directions generally perpendicular to the longitudinal. "Forward" should be understood to mean toward bow 16, and "rearward" should be understood to mean toward stern 22. "Upward" should be understood to mean toward upper hull body side 26, and "downward" meaning a direction toward lower hull body 28. Mounting surface 40 includes a first peripheral edge 42 and a second peripheral edge 44. First peripheral edge 42 and second peripheral edge 44 may extend from central keel 38 to transom 24, and are oriented so as to diverge from one another rearwardly from central keel 38. In one implementation a footprint in a projection plane defined by first peripheral edge 42 and second peripheral edge 44 has a paraboloid shape. Mounting surface 40 further includes a planar mounting face 46 extending forwardly from stern 22, and a transition face 48. Mounting face 46 transitions with and adjoins transom 24 in the illustrated embodiment. Transition face 48 slopes forwardly and downwardly from mounting face 46 to central keel 38, such that mounting surface 40 has a concave longitudinal profile.

Figure 3:
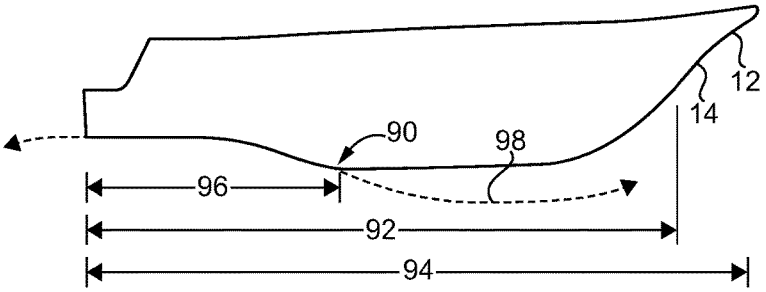
FIG. 3 is a side diagrammatic view of a marine vessel hull as in FIG. 1 and FIG. 2.

Referring also now to FIG. 3, the concave longitudinal profile of hull body 14 is shown. Also depicted in FIG. 3 is a total length 94 of hull body 14, and a waterline length 92 that is less than total length 94. At reference numeral 96, a longitudinal, straight-line length of mounting surface 40 is shown. It can be seen from FIG. 3 that mounting face 46 has a generally linear longitudinal profile, and that transition face 48 has a curvilinear longitudinal profile. In one implementation transition face 48 has a continuously varying curvature, and in a further refinement the continuously varying curvature has a sine wave pattern. In FIG. 3 line 98 identifies the sine wave pattern that can be understood to be defined by the curvature of transition face 48. The sine wave pattern may have a zero-axis crossing point that is coincident with an intersection 90 between central keel 38 and mounting surface 40. It can also be seen that line/sine wave 98 has a wavelength such that about one half period or 180 degrees of the sine wave is substantially equal to waterline length 92. Geometric attributes, including the concave profile, curved shape, sine wave pattern of curvature, length, and still others, of mounting surface 40 assist in delivering and directing flow of water to the center propulsor 32. It can be noted that hull 12 does not have a central tunnel associated with the center propulsor.

Figure 4:
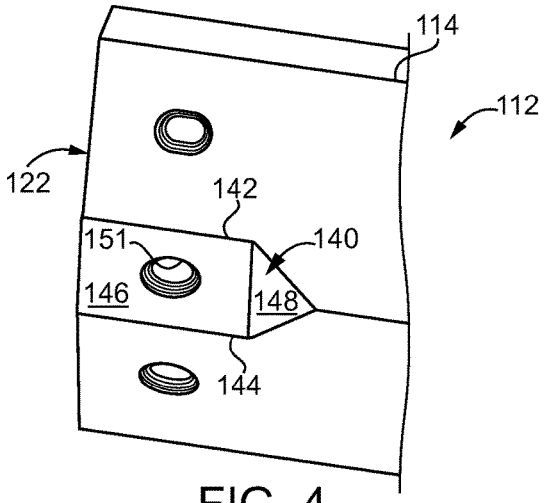
FIG. 4 is a partial view of a marine vessel hull, according to another embodiment.

Referring now to FIG. 4, there is shown a vessel hull 112 including a hull body 114 having a stern 122, according to another embodiment. It can be seen from FIG. 4 that hull body 114 has a number of similarities with previously described embodiments, but also certain differences. Hull body 114 includes a mounting surface 140 that has a mounting face 146 and a transition face 148, a first peripheral edge 142 and a second peripheral edge 144. Mounting surface 140 further has a concave longitudinal profile. Rather than a curvilinear profile as in the embodiment described above, the concave longitudinal profile defined by mounting face 140 includes a linear segment defined by mounting face 146 and another linear segment defined by transition face 148. Transition face 148 may be oriented at an angle, typically between about 30° and about 60°, to mounting face 146. An aperture 151 is formed in mounting face 146, and additional apertures (not numbered) are shown at outboard locations. In an implementation, aperture 151 is structured to receive a break-away mount for mounting a propulsor pod therein.

Returning to FIG. 2, there is shown a break-away mount 50 received within an aperture 51 formed in mounting face 46. In the case of collision with an underwater obstruction or the like, the center mounted propulsor 32 and break-away mount 50 can break away from hull body 14. Also depicted in FIG. 2, illustrating a feature that could analogously be applied to all the embodiments contemplated herein, is a clearance or stand-back 52 extending circumferentially around break-away mount 50. Stand-back 52 can be planar and forms an unobstructed zone that is a majority of a longitudinal length and a majority of a latitudinal width of mounting face 46, in at least some embodiments. Break-away mounts and stand back zones could be analogously applied to the starboard and port propulsors 32 in a practical implementation strategy.

Figure 5:
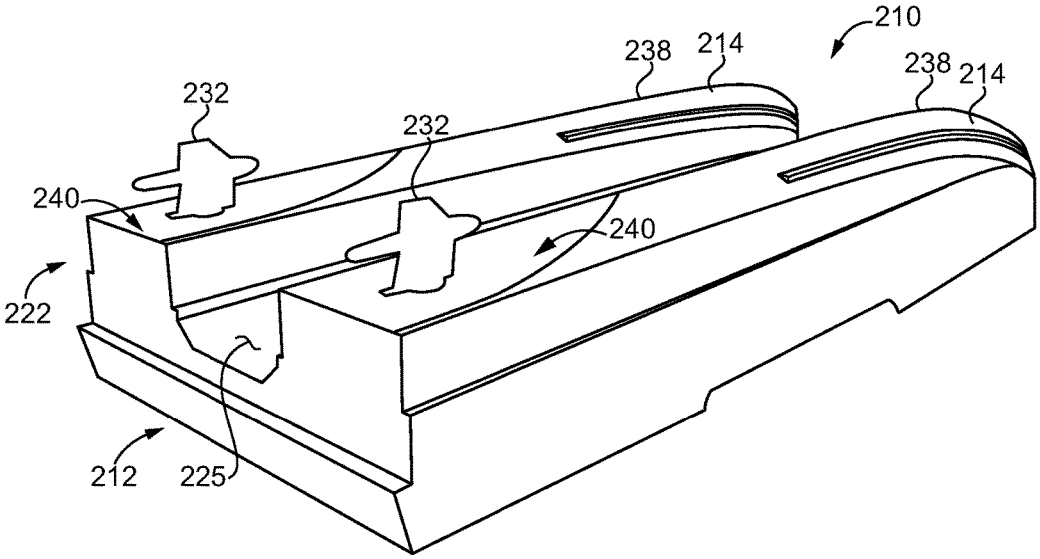
FIG. 5 is a perspective view of a marine vessel, according to yet another embodiment.

Referring now to FIG. 5, there is shown a marine vessel 210 according to another embodiment, and having a plurality of vessel hull bodies 214 in a vessel hull 212. In the illustrated embodiment, each hull body 214 is one of two substantially identical, albeit mirror-image hull bodies in a catamaran configuration. More than two hull bodies might be used in still other implementations. The embodiment of FIGS. 1-4 could be understood as so-called mono-hull configurations. A tunnel 225 or clearance extends longitudinally between hull bodies 214. Each hull body 214 also has a longitudinally extending central keel 238, and a pod mounting surface 240 for mounting a propulsor 232 at or adjacent to a stern 222, generally analogous to the aforementioned embodiments. Mounting surfaces 240 could be identically configured to either of mounting surfaces 40 or 140 in the previously described embodiments.

INDUSTRIAL APPLICABILITY

Figure 6:
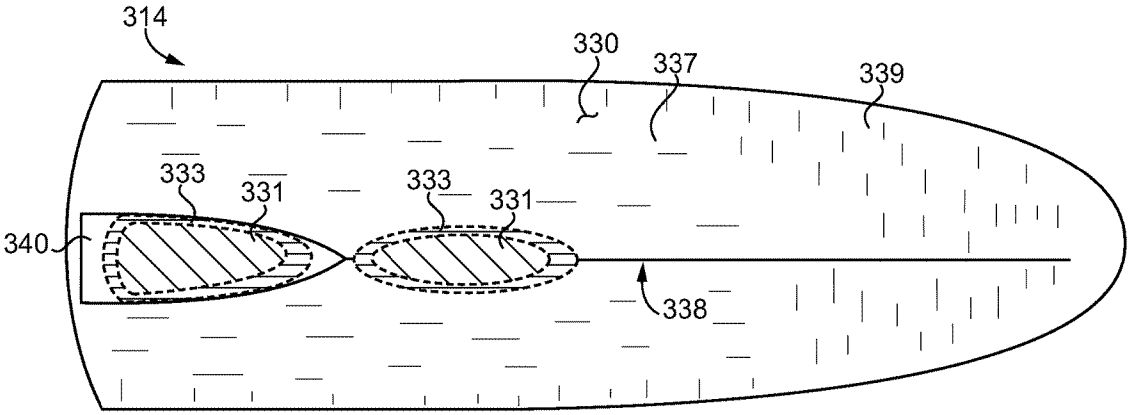
FIG. 6 is a concept illustration of fluid pressures that might be observed on a bottom surface of a marine vessel hull according to the present disclosure under a first set of conditions.

Referring to the drawings generally, but in particular now to FIG. 6, there is shown a bottom view illustrating fluid pressure properties that might be observed during operating a marine vessel according to the present disclosure. A vessel hull is depicted at 314 and includes a central keel 338 formed in a hull bottom 330 having a pod mounting surface 340. Hull body 314 might be analogously configured to hull body 14 in marine vessel 10 described above, however, it will be appreciated that the principles discussed herein may be expected to apply to all the various different embodiments contemplated herein. In FIG. 6 a lowest fluid pressure or zero pressure might be observed at parts of hull body 314 not necessarily below the waterline during operation and marked with vertical lines, 339, with a higher pressure observed at portions of hull bottom 330 marked with horizontal lines 337. In zones 333, a still higher fluid pressure 333 might be observed, and in zones 331 a still higher fluid pressure might be observed. In the FIG. 6 illustration the corresponding marine vessel might be about 50 feet long and operated at about 24 knots.

Figure 7:
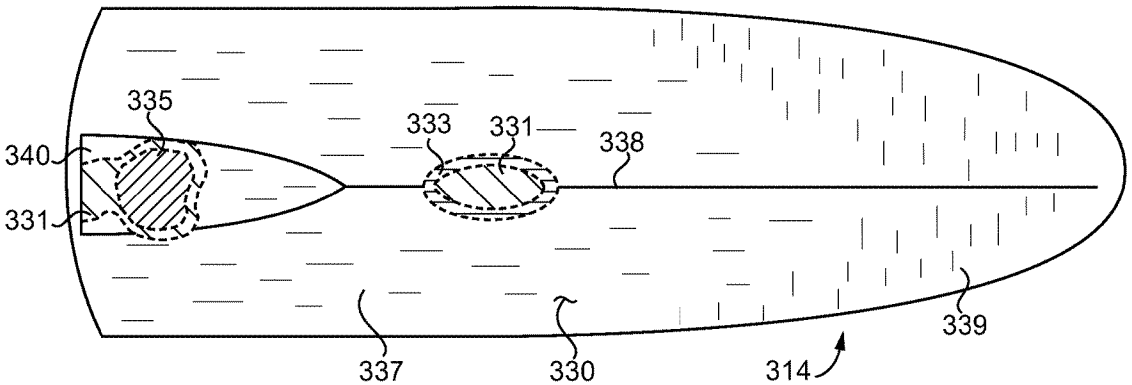
FIG. 7 is a concept diagram of fluid pressures that might be observed on a bottom surface of a marine vessel hull according to the present disclosure under a different set of conditions.

Referring to FIG. 7, there is shown the same marine vessel with fluid pressure on hull body 314 illustrated as it might appear where operated at about 30 knots. In FIG. 7 it can be seen that fluid pressures that are generally analogous to those observed in FIG. 6 are shown at zones 331 and 333. A still higher pressure is observed at 335 within and acting upon mounting surface 340. It will thus be understood from FIGS. 6 and 7 that a relatively high fluid pressure that can act generally in an upward or lifting direction might be observed acting upon mounting surface 340. The upward or lifting fluid pressure could increase with an increase in speed. It will be appreciated the upward or lifting pressure can reduce drag on the marine vessel during operation. With further increases in speed, however, hull body 314 might be lifted further out of the water by other factors and therefore result in a decrease in upward or lifting pressure acting upon mounting surface 340. It should be appreciated that the illustrations in FIGS. 6 and 7 are conceptual and could vary based upon a variety of different factors including vessel speed, vessel loading, alternative hull designs, and still others.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A marine vessel comprising:

a vessel hull including a hull body having a bow, a stern, an upper hull body side, and a lower hull body side having a hull bottom;

the hull bottom including a first hull bottom side surface and a second hull bottom side surface, the first hull bottom side surface and the second hull bottom side surface adjoining one another in a V-pattern so as to form a central keel;

the hull bottom further including a contoured pod mounting surface positioned longitudinally between the central keel and the stern and having a first peripheral edge and a second peripheral edge oriented so as to diverge from one another rearwardly from the central keel;

the contoured pod mounting surface further including a planar mounting face extending forwardly from the stern, and a transition face sloping forwardly and downwardly from the planar mounting face to the central keel, such that the contoured pod mounting surface forms, within the transition face, has' a concave longitudinal profile that extends from the planar mounting face to the central keel; and a propulsor pod mounted upon the planar mounting face.

2. The marine vessel of claim 1 wherein the transition face has a curvilinear longitudinal profile.

3. The marine vessel of claim 1 wherein the transition face has a continuously varying curvature.

4. The marine vessel of claim 3 wherein the continuously varying curvature has a sine wave pattern.

5. The marine vessel of claim 1 wherein the first hull bottom side surface and the second hull bottom side surface form a deadrise at the stern.

6. The marine vessel of claim 5 further comprising a second propulsor pod mounted upon a starboard side of the pod mounting surface and a third propulsor pod mounted upon a port side of the pod mounting surface.

7. The marine vessel of claim 5 further comprising a break-away mount supporting the propulsor pod.

8. A vessel hull for an inboard-powered marine vessel comprising:

a hull body including a bow having a forwardly positioned nose, a stern having a rearwardly positioned transom, an upper hull body side, and a lower hull body side having a hull bottom;

the hull bottom including a first hull bottom side surface and a second hull bottom side surface, the first hull bottom side surface and the second hull bottom side surface adjoining one another in a V-pattern so as to form a central keel;

the hull bottom further including a contoured pod mounting surface positioned longitudinally between the central keel and the stern and having a first peripheral edge and a second peripheral edge oriented so as to diverge from one another rearwardly from the central keel; and the contoured pod mounting surface further including a planar mounting face, for mounting a propulsor pod, extending forwardly from the stern, and a transition face sloping forwardly and downwardly from the planar mounting face to the central keel, such that the contoured pod mounting surface forms, within the transition face, a concave longitudinal profile, that extends from the planar mounting face to the central keel.

9. The vessel hull of claim 8 wherein the first hull bottom side surface and the second hull bottom side surface form a deadrise at the stern.

10. The vessel hull of claim 9 wherein the hull body includes a mono-hull.

11. The vessel hull of claim 10 wherein the hull bottom further includes a second planar face for mounting a second propulsor pod on a starboard side of the pod mounting surface and a third planar face for mounting a third propulsor pod on a port side of the pod mounting surface.

12. The vessel hull of claim 9 wherein the hull body is one of two or more hull bodies in a catamaran configuration.

13. The vessel hull of claim 8 wherein the transition face has a curvilinear longitudinal profile.

14. The vessel hull of claim 13 wherein the transition face has a continuously varying curvature.

15. The vessel hull of claim 14 wherein the continuously varying curvature has a sine wave pattern.

16. The vessel hull of claim 15 wherein the sine wave pattern has a zero-axis crossing point that is coincident with an intersection between the central keel and the pod mounting surface.

17. The vessel hull of claim 8 wherein the pod mounting surface has a paraboloid footprint.

18. A vessel hull for an inboard-powered marine vessel comprising:

a hull body including a bow having a forwardly positioned nose, a stern having a rearwardly positioned transom, an upper hull body side, and a lower hull body side having a hull bottom;

the hull bottom including a first hull bottom side surface and a second hull bottom side surface, the first hull bottom side surface and the second hull bottom side surface adjoining one another in a V-pattern so as to form a central keel extending rearwardly from the bow, and a deadrise at the stern;

the hull bottom further including a contoured pod mounting surface positioned longitudinally between the central keel and the stern, and latitudinally between the first hull bottom side surface and the second hull bottom side surface;

the contoured pod mounting surface having a planar mounting face, for mounting a propulsor pod, and a transition face each positioned between a first peripheral edge and a second peripheral edge, the first peripheral edge and the second peripheral edge extending from the central keel to the transom and being oriented so as to diverge from one another rearwardly from the central keel; and the planar mounting face and the transition face each being positioned between the first peripheral edge and the second peripheral edge, and the transition face sloping forwardly and downwardly from the planar mounting face to the central keel and having, in profile, a concave upward curvature adjoining the central keel.

19. The vessel hull of claim 18 wherein the transition face has a curvilinear longitudinal profile.

20. The vessel hull of claim 18 wherein the hull bottom further includes a second planar face for mounting a second propulsor pod on a starboard side of the pod mounting surface and a third planar face for mounting a third propulsor pod on a port side of the pod mounting surface.

* * * * *